US010359163B1

(12) United States Patent
Hettwer et al.

(10) Patent No.: US 10,359,163 B1
(45) Date of Patent: Jul. 23, 2019

(54) ACCESSIBLE CEILING BAFFLES WITH INTEGRATED LIGHTING, CUSTOM PERFORATION, AND ACOUSTICS

(71) Applicant: USG Interiors, LLC, Chicago, IL (US)

(72) Inventors: Stephen Hettwer, Brea, CA (US); Rana Ahmadi, Glendale, CA (US); James Langan, Eagle, ID (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/174,732

(22) Filed: Oct. 30, 2018

(51) Int. Cl.

| | |
|---|---|
| ***F21S 8/06*** | (2006.01) |
| ***F21V 5/00*** | (2018.01) |
| ***F21V 29/83*** | (2015.01) |
| ***F21V 15/015*** | (2006.01) |
| ***F21Y 103/10*** | (2016.01) |
| ***F21Y 115/10*** | (2016.01) |
| ***G10K 11/162*** | (2006.01) |

(52) U.S. Cl.
CPC ..... *F21S 8/06* (2013.01); *F21V 5/007* (2013.01); *F21V 29/83* (2015.01); *G10K 11/162* (2013.01); *F21V 15/015* (2013.01); *F21Y 2103/10* (2016.08); *F21Y 2115/10* (2016.08)

(58) Field of Classification Search
CPC .. F21S 8/06; F21V 29/83; F21V 5/007; F21V 15/015; G10K 11/162; F21Y 2103/10; F21Y 2115/10
See application file for complete search history.

(56) References Cited

U.S. PATENT DOCUMENTS

| | | | | |
|---|---|---|---|---|
| 2,659,808 | A * | 11/1953 | Beckwith | E04B 9/34 181/289 |
| 2012/0236537 | A1* | 9/2012 | Pickard | F21K 9/00 362/84 |
| 2018/0334804 | A1* | 11/2018 | Patterson | E04B 9/26 |

* cited by examiner

*Primary Examiner* — Mary Ellen Bowman
(74) *Attorney, Agent, or Firm* — Pearne & Gordon LLP

(57) ABSTRACT

An acoustical and illumination baffle for suspension in a ceiling area comprising a housing and a light strip in the housing, the housing being an elongated sheet metal hollow body with opposed sidewalls and a bottom wall, at least a portion of the sidewalls and/or the bottom wall having perforations, a visible light emitting strip within the housing and extending along a major part of the length of the housing and extending a major part of a length of the housing, the light emitting strip being arranged to radiate visible light through an open area in a wall of the housing thereby illuminate an area below the housing, the perforations serving to reduce noise existing in the area below the baffle and to allow cooling air circulation through the housing.

4 Claims, 7 Drawing Sheets

FIG. 1
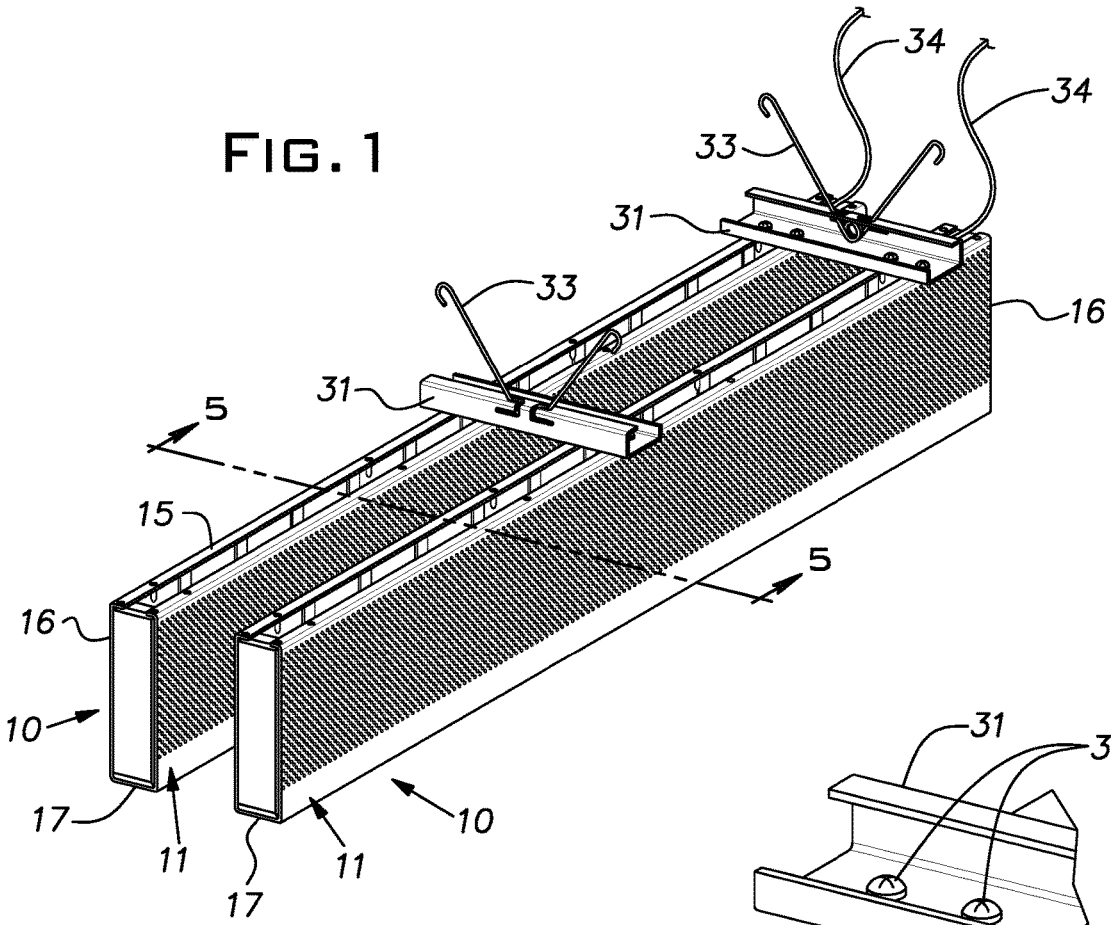
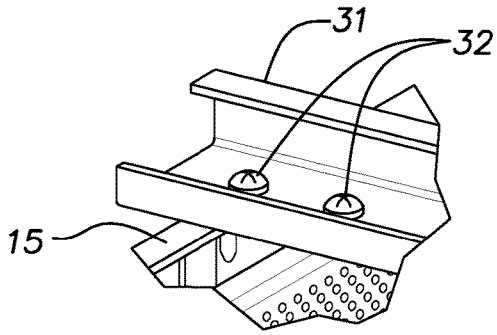
FIG. 2
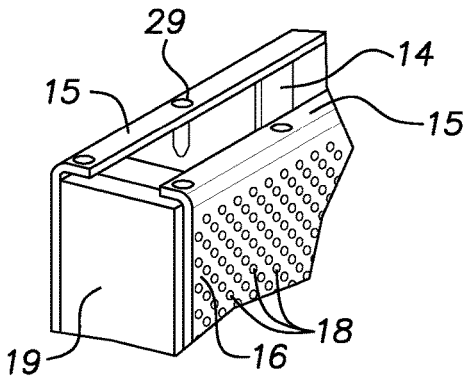
FIG. 3

33
31
33
31
13
13
14
14
12
12
26
27
26
27
15
15
16
17
25
18
17
11
16
17
25
11
19
19

ACCESSIBLE CEILING BAFFLES WITH INTEGRATED LIGHTING, CUSTOM PERFORATION, AND ACOUSTICS

BACKGROUND OF THE INVENTION

The invention relates to suspended ceiling construction and, more particularly, to a novel ceiling baffle.

PRIOR ART

It is known to suspend a parallel array of baffles at ceiling height to reduce noise in the underlying space or area and/or provide an attractive visual ceiling boundary for the space. It is customary to illuminate an area with overhead lighting fixtures in a ceiling structure. At times, the lighting fixtures distract from the appearance of a ceiling structure by interrupting the continuity or pattern uniformity of the ceiling structure.

SUMMARY OF THE INVENTION

The invention provides a ceiling baffle construction that affords both acoustical and illumination properties. The illumination components are all contained within a baffle so that the baffle exterior is indistinguishable from non-illuminated like baffle units. This feature allows visual uniformity to be obtained in a ceiling structure where a limited number of illuminated baffles are distributed among a number of non-illuminated baffles.

Ordinarily, in use of the invention illuminated and non-illuminated baffles are of the same housing construction, typically comprising elongated channels or tubes of sheet metal having walls or faces with a desired pattern of perforations or holes. Perforation and/or slot arrangements can be used where functional down lighting is desired and larger perforations can be used to produce ambient lighting patterns on surrounding walls, floors and other surfaces. The inventive baffles contain a light strip that can be of essentially the same length as that of the baffle. In some versions, the baffle can contain, along with a light strip, sound absorbing medium such as a porous batte of non-woven fiber.

While the light strip assemblies are fully contained in respective baffles, heat build-up in the baffle space detrimental to the light elements can be reduced by air currents passing through the baffle wall perforations as well as conduction through the baffle walls themselves.

BRIEF DESCRIPTION OF THE DRAWINGS

FIG. 1 is a perspective view of a pair of parallel baffles, arranged as a cassette and constructed in accordance with a first embodiment or version of the invention;

FIG. 2 is a fragmentary perspective view showing a typical attachment of a backslat to a baffle or bar;

FIG. 3 is a fragmentary perspective view showing a typical attachment of a cage for sound absorbing material in a baffle;

DESCRIPTION OF THE PREFERRED EMBODIMENTS

Figure 4:
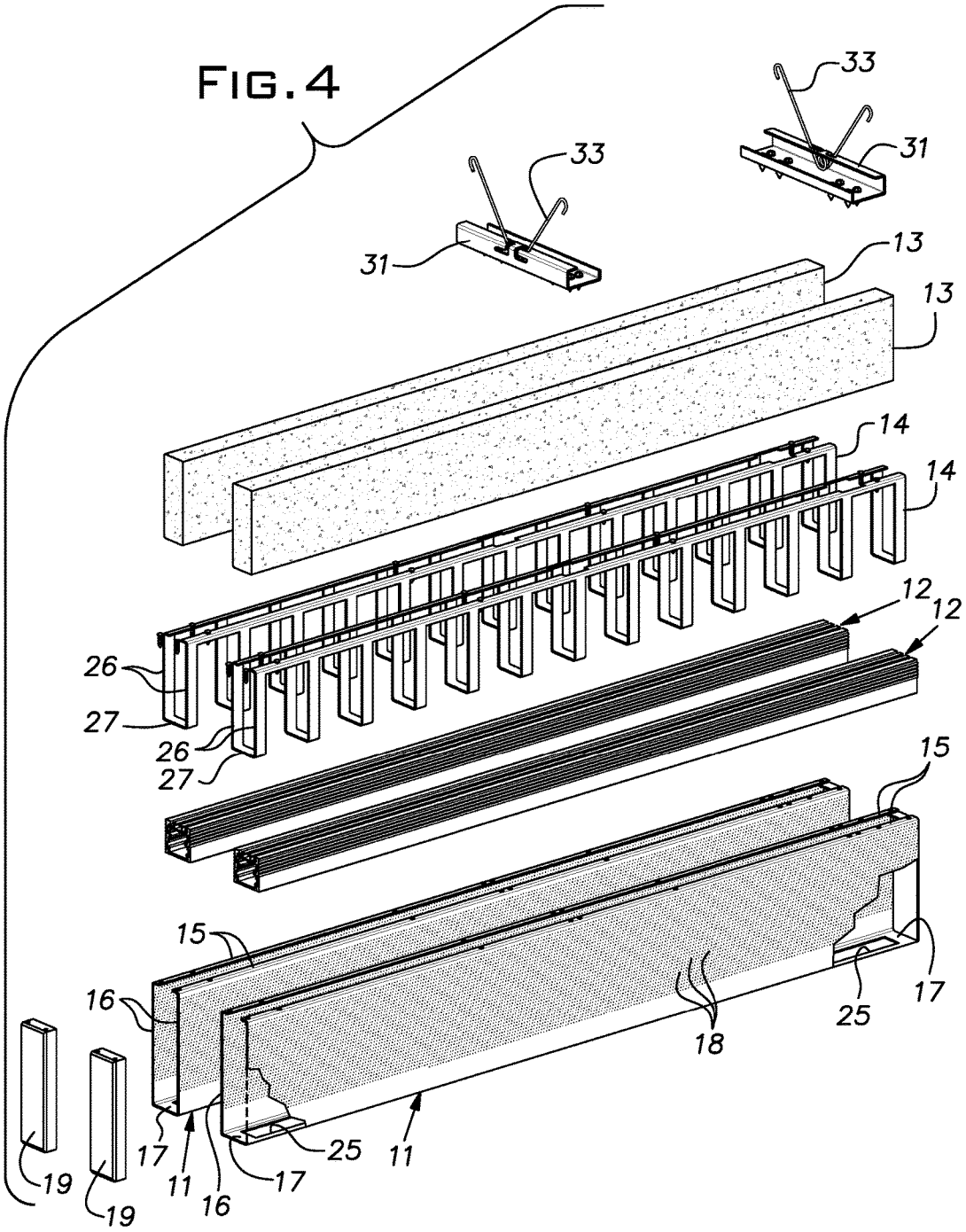
FIG. 4 is an exploded perspective view of the first embodiment of the baffle assembly of the invention.

A pair of baffles 10 illustrated in FIG. 1 are suitable for use with other like baffles in a coplanar spaced parallel array to form an open plenum suspended ceiling as known in the art. Multiple baffles 10 can be joined, as shown in FIG. 1, to form a cassette that can be mounted and lowered as a unit for access to the plenum. In the embodiment of FIGS. 1-5, a baffle 10 is an assembly of a sheet metal housing 11, a light strip 12, sound absorbing material 13 and a cage 14 for the sound absorbing material.

The housing 11 is an elongated hollow body, in the present case having a rectangular U-shaped cross-section comprising opposed vertical flat sides 16 and a horizontal bottom side 17 integrally joined to the lower edges of the vertical sides. Other hollow cross-sectional shapes can be employed with this and other embodiments of the invention.

Integral inturned flanges 15 exist at upper edges of the sidewalls 16. The bottom wall 17 has a lengthwise extending continuous central slot or open area 25 and lower portions of the sidewalls 16 have an open area in the form of a uniform pattern of small perforations or holes 18, sometimes called micro perforations. Where ends of the housing 11 will be exposed, the ends can be closed with end caps 19 made of sheet metal or plastic and optionally duplicating the perforation pattern of the side walls 16. The length of a housing is any desired practical length, for example, between 4 foot and 8 or 10 foot. Widths of a housing 11 can range, for example, between 1 inch and 6 inches and heights can range, for example, between 4 inches and 12 inches.

Housings 11 can be joined end-to-end to extend over greater distances. Where housings are joined as cassettes, their combined width may range, for example, between 18 inches and 36 inches. Typically, the body of a housing 11 is fabricated from sheet metal, ordinarily aluminum sheet stock with a gauge of between 0.032 inches and 0.040 inches depending on the housing size.

The light strip 12 is disposed in the baffle housing 11. In the illustrated examples, the light strip 12 is an assembly comprising an extruded rectangular U-shaped carrier 21, an LED (light emitting diode) tape light 22 and a lens 23 all of a length substantially equal to the length of the housing 11. The components of the light strip assembly 12 are available commercially from Optic Arts, Monterey Park, Calif. 91754. The LED tape light comprises a series of LEDs uniformly spaced and attached to a support strip that also supports electrical conductors for energizing the LED, as is known in the art.

Figure 5:
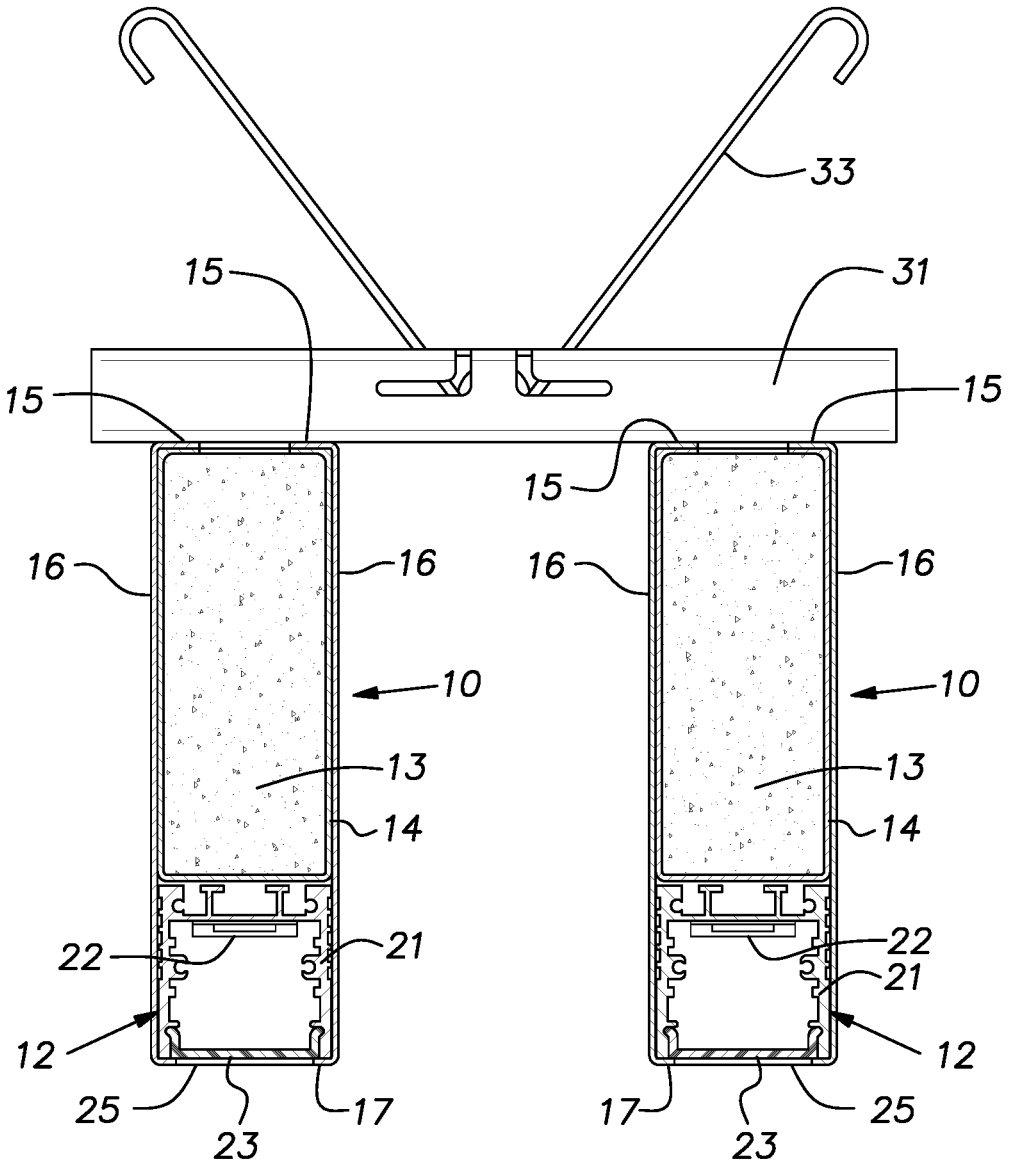
FIG. 5 is a cross-sectional view of the pair of baffle assemblies taken in the plane 5-5 indicated in FIG. 1.

The lens 23, snap fitted or otherwise retained on the carrier extrusion 21, diffuses visible light emitted by the spaced LEDs that act similarly to a point source. As shown in FIG. 5, the light strip assembly 12 is located at or adjacent the bottom wall 17 of the housing 11 with the LED tape strip spaced from this bottom wall. The light strip assembly 12 may herein be referred to as simply the light strip.

The cage 14 is an elongated element of sheet metal, for example, having a rectangular U-shaped cross-section proportioned to fit within the housing 11 above the light strip assembly 12. Sides of the cage 14 are open between spaced vertical bars 26. Spaced bottom webs 27 of the cage 14 are integral with lower ends of the bars 26. The cage 14 is filled with sound absorbing material, typically a non-woven porous fiber material 13. The material filled cage can be assembled in the housing 11 by sliding it in endwise; thereafter, the cage 14 and contained material can be fixed in position with screws 29 through the housing flanges 15 as shown in FIG. 3. The cage 14 serves to maintain the acoustical material 13 out of contact with the light strip 12.

The illustrated pair of baffles or assemblies 10 are joined together as a cassette in spaced parallel relation with backslats 31 attached with screws 32 (FIG. 2) into the housing flanges 15. The backslats 31 are fitted with torsion springs 33, as known in the art, that serve to suspend the baffle assemblies or cassettes on a grid (not shown) having slots located and proportioned to receive the springs in a manner that resiliently draws the baffle assemblies 10 up against the grid. The torsion springs 33 allow the baffle assemblies to be manually pulled down for access to the plenum space above a ceiling formed by a multitude of baffles. Electrical wire leads 34 from the LED tape lights 22, schematically shown in FIG. 1, are connected in series to wires of an end joined baffle 10 and/or an external power supply. Alternatively, the power supply can be integrated with the LED tape light 22.

The baffle assemblies 10, typically installed with numerous other like baffle assemblies to form an open plenum suspended ceiling, serve to absorb noise emanating from the space below the ceiling. The openings or perforations in the walls of a baffle housing 11 serve several functions. The perforations 18 augment the sound absorbing function of the baffle assembly 10. The slot or opening 25 passes visible light emitted by the LED light strip 22 to downlight the space below. Still further, the perforations 18 promote air circulation in and out of the housing 11 which can serve to reduce build-up of heat in the housing which can be detrimental to the light strips 22. The relatively large external surface area of the metal baffles 10, particularly the vertical portions, serve to transfer heat to the ambient air.

Referring to FIGS. 6-10, a second version or embodiment of a baffle assembly is shown. Parts that are the same or substantially the same in construction and/or function as those described in connection with the embodiment of FIGS. 1-5 are designated with the same numerals. The baffle housing 11 has perforations or holes 18 in a gradient pattern, becoming smaller in diameter with distance from the bottom wall 17.

Figure 8:
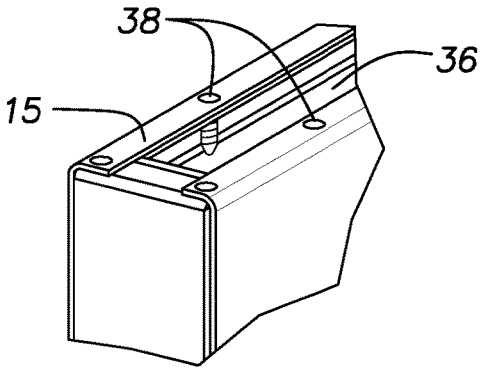
FIG. 8 is a fragmentary perspective view showing a typical attachment of a light strip backer to a baffle housing.

The light strip assembly 12 is located at an upper region in the housing 11 adjacent the flanges 15. In the illustrated arrangement, the light strip assembly 12 is retained in position by a backer strip 36 fixed to the light strip assembly 12 by screws 37 (FIG. 9) and fixed to the housing by screws 38 extending through the flanges 15 (FIG. 8).

Figure 6:
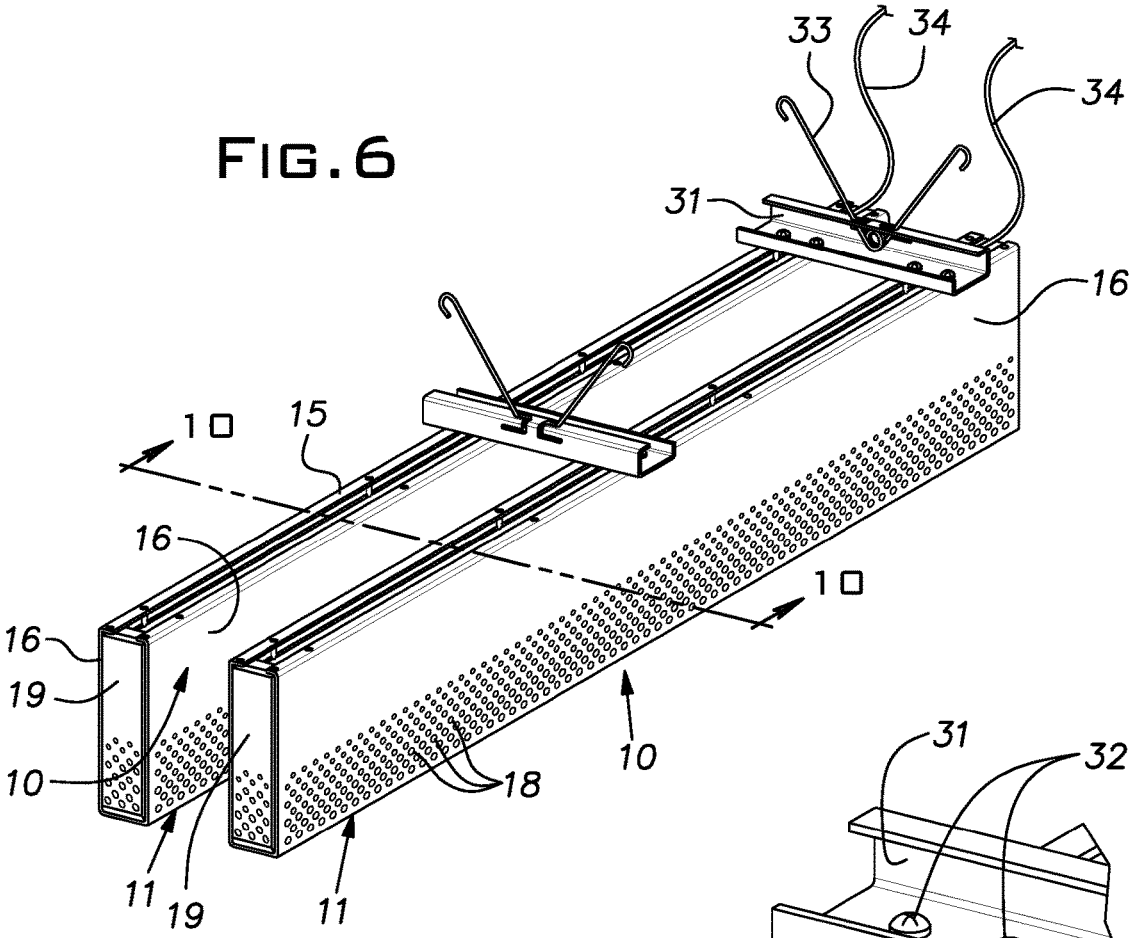
FIG. 6 is a perspective view of a pair of parallel baffles forming a cassette and constructed in accordance with a second embodiment or version of the invention.
Figure 7:
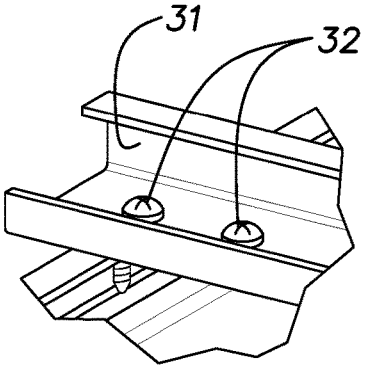
FIG. 7 is a fragmentary perspective view showing a typical attachment of a backslat to a baffle.
Figure 9:
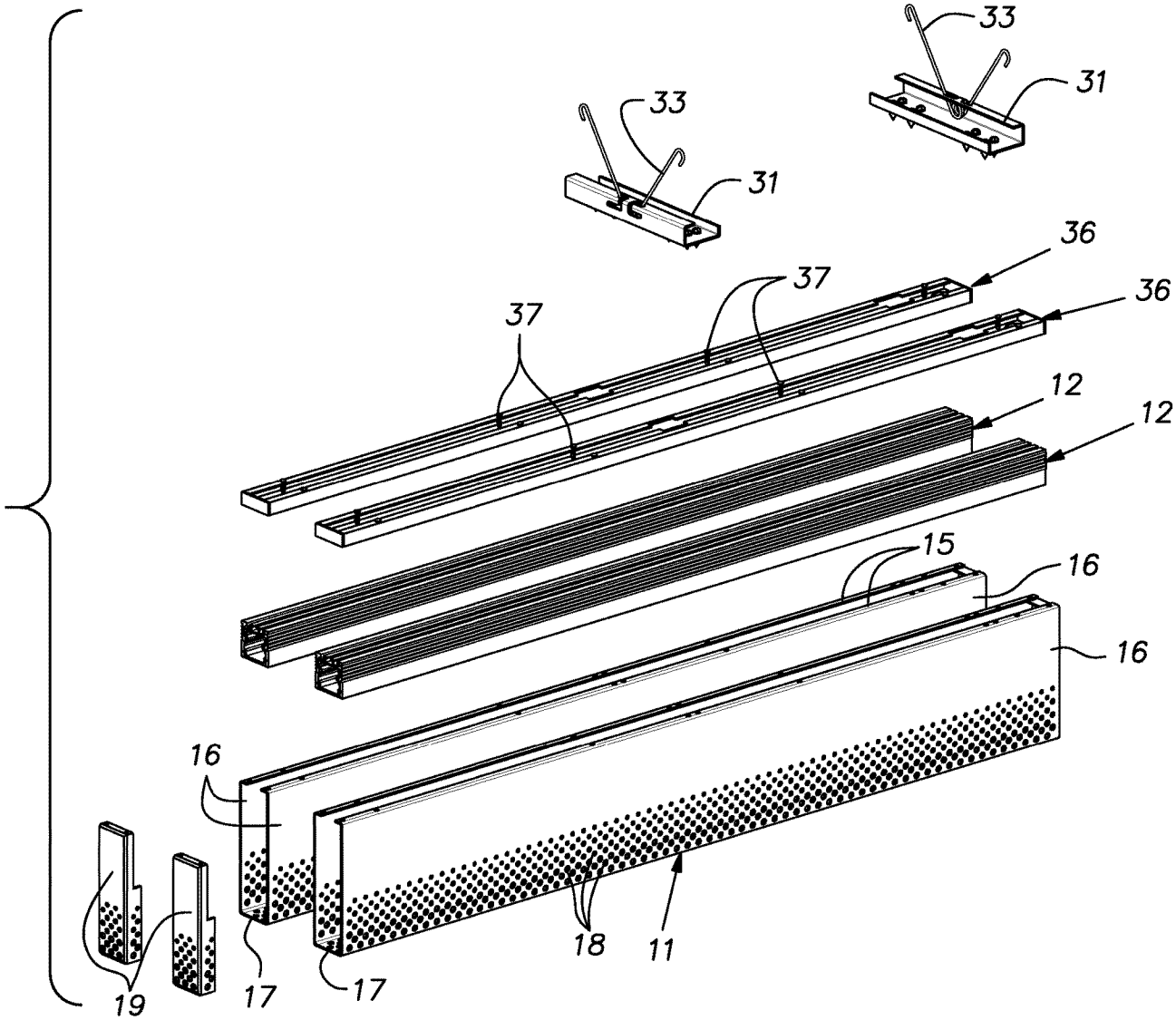
FIG. 9 is an exploded perspective view of the second embodiment or version of the baffle assembly of the invention.
Figure 10:
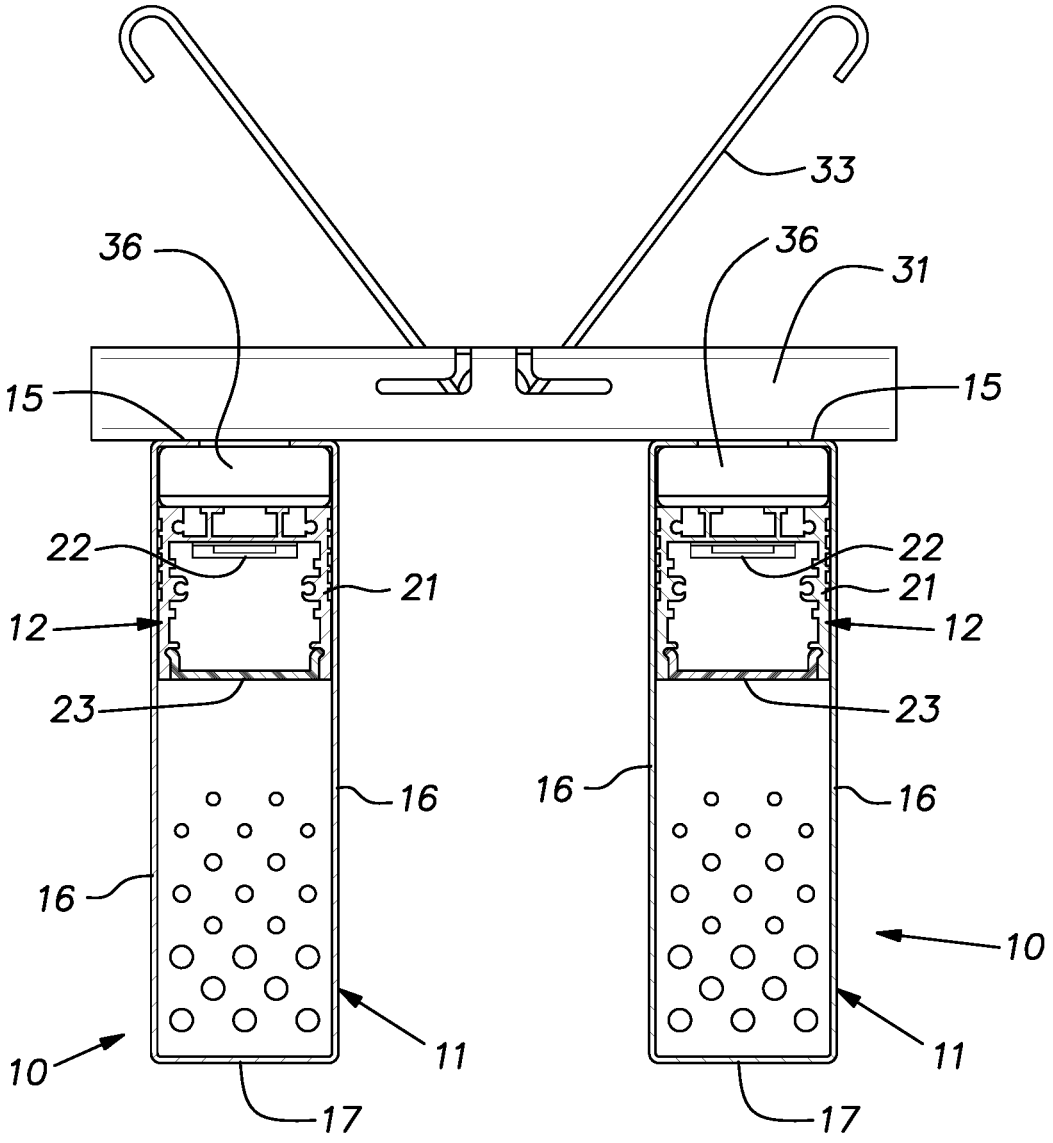
FIG. 10 is a cross-sectional view of the pair of baffle assemblies taken in the plane 10-10 indicated in FIG. 6.
Figure 11:
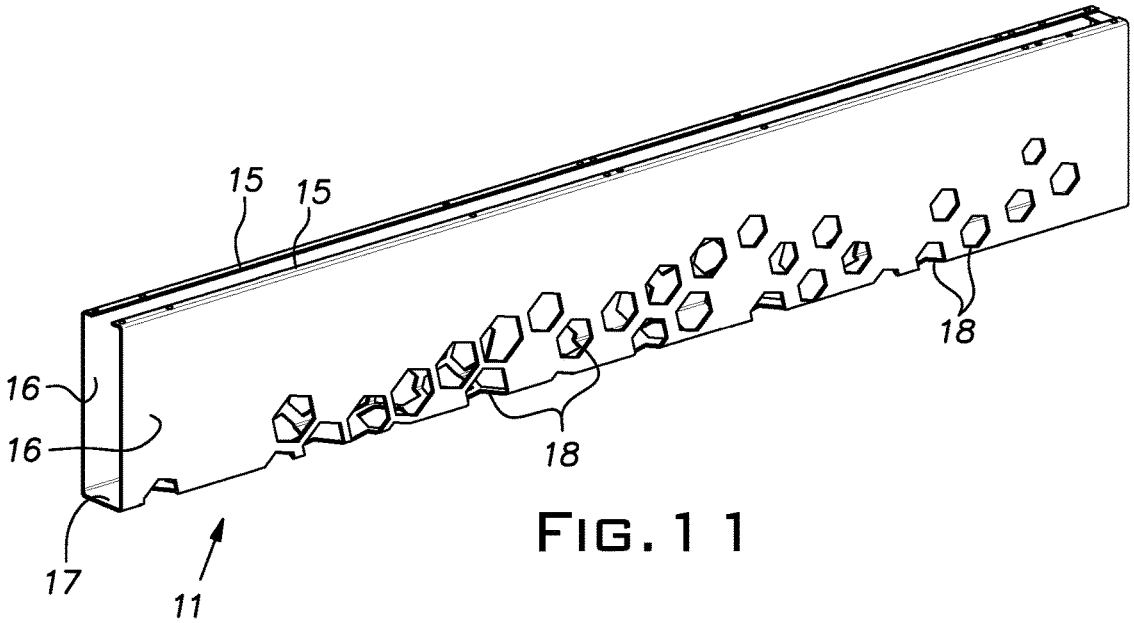
FIG. 11 is a perspective view of a variation of a baffle housing.

The relatively small perforations 18 illustrated in FIGS. 6 and 9 provide aesthetically pleasing functional down lighting when the light strip 22 is electrically energized and radiating visible light. FIG. 11 illustrates a housing 11, with relatively large randomly located perforations or holes 18, that can be substituted for the housing 11 of FIGS. 6 and 9. Relatively large holes, when the light strip 22 is energized and radiating light, produce both functional down lighting and ambient lighting by projecting perforation patterns onto adjacent walls, floors, and other nearby surfaces.

Where relatively wide baffles are used, more than one light strip assembly 12 can be disposed side-by-side in a housing 11. The inventive illuminated baffles 10 can be used with non-illuminated baffles, typically having housings identical to the illuminated housing in an open plenum ceiling arrangement. In such arrangements, the lighting componentry is visually unobtrusive.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An acoustical and illumination baffle for suspension in a ceiling area comprising a housing and a light strip in the housing, the housing being an elongated sheet metal hollow body with opposed sidewalls and a bottom wall, at least a portion of the sidewalls and/or the bottom wall having perforations, the light strip including a visible light emitting strip within the housing and extending along a major part of the length of the housing, the light emitting strip being arranged to radiate visible light through an open area in a wall of the housing thereby illuminating an area below the housing, the perforations serving to reduce noise existing in the area below the baffle and to allow cooling air circulation through the housing, the light emitting strip being an assembly of an extruded U-shaped carrier with opposed walls, a tape carrying LED elements in the carrier between the opposed walls and a transparent and/or translucent lens located between the opposed walls of the carrier.

2. A baffle as set forth in claim 1, wherein the light emitting strip comprises a linear array of LED elements.

3. A baffle as set forth in claim 2, wherein the lens is disposed between the LED elements and an open area of a housing wall receiving radiation that distributes the light radiation from the LED elements over a surface area greater than a radiating surface area of the LED elements.

4. A baffle as set forth in claim 1, wherein a porous non-woven sound absorbing material is contained in the housing above the light emitting strip.

* * * * *